US006409490B1

(12) United States Patent
Nemit, Jr. et al.

(10) Patent No.: US 6,409,490 B1
(45) Date of Patent: Jun. 25, 2002

(54) ROTARY SCREW COMPRESSOR WITH SLIDE VALVE AND SLIDE STOP GUIDANCE BUSHINGS

(75) Inventors: Paul Nemit, Jr., Roanoke, VA (US); Charles M. Beall, Jr., Hagerstown, MD (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/864,234

(22) Filed: May 25, 2001

(51) Int. Cl.[7] ..... F04C 18/16; F04C 29/08
(52) U.S. Cl. ..... 418/201.2
(58) Field of Search ..... 418/201.2

(56) References Cited

U.S. PATENT DOCUMENTS 3,088,659 A 5/1963 Nilsson et al. ..... 418/201.2
4,457,681 A 7/1984 Garland ..... 418/201.2
4,516,914 A 5/1985 Murphy et al. ..... 418/201.2
4,611,976 A 9/1986 Schibbye et al. ..... 418/201.2
4,913,634 A 4/1990 Nagata et al. ..... 418/201.2
5,123,822 A 6/1992 Yoshimura ..... 418/201.2
6,082,985 A * 7/2000 Suzuki et al. ..... 418/201.2

* cited by examiner

*Primary Examiner*—John J. Vrablik
(74) *Attorney, Agent, or Firm*—Dowell & Dowell, P.C.

(57) ABSTRACT

In a screw compressor, guide bushings are mounted within bores for the bearings which support rotor shafts for the compressor. First bushings are provided at an inlet casing of the compressor and provide guidance for a slide stop and second bushings are provided in an outlet casing of the compressor to provide guidance for a slide valve. The bushings are also mounted to the inlet and outlet casings to provide centering for two sections of the compressor rotor housing. In one embodiment the first and second bushings provide guidance for a slide valve.

21 Claims, 4 Drawing Sheets

ROTARY SCREW COMPRESSOR WITH SLIDE VALVE AND SLIDE STOP GUIDANCE BUSHINGS

BACKGROUND OF THE INVENTION

1. Field of the Invention

This application is generally directed to the field of rotary screw compressors and more particularly to means for providing positive guidance for a slide valve or a slide stop and a slide valve assembly which are utilized to govern the capacity and the compression ratio of compressors. More specifically, the present invention is directed to providing specially configured bushings having outer arcuate guide surfaces for engaging arcuate upper surfaces of a slide valve or slide stop and slide valve assembly to ensure a close non-interfering tolerance between the slide stop, slide valve and intermeshing rotors of the screw compressor.

2. Brief Discussion of the Related Art

Rotary screw compressors of the type which are utilized for compressing a refrigerant gas or other fluid conventionally include a pair of rotors having intermeshing lands and grooves helically disposed about the periphery thereof. A working fluid enters the compressors from an inlet port and enters the grooves between the rotors. The rotation of the rotors forms somewhat chevron-shaped compression chambers in which the working fluid is received and which chambers diminish in volume as the chambers move toward an outlet in the compressors' outlet casings. The working fluid is discharged when the crest of the rotor lands defining the leading edge of a compression chamber pass an edge of the discharge ports in the discharge casings of the compressors.

To provide a controlled variation in volumetric capacity simultaneously with controlling compression ratio, it has been known to utilize a combined valve, otherwise known as a slide valve and slide stop which are axially aligned with one another within a recess or bore which communicates along its full length with the bores of the compressor in which the rotors are mounted. The end of the slide valve is moveable relative to the discharge port and its position is used to govern the compression ratio of the compressor. Further, by spacing the slide stop and slide valve relative to one another, it is possible to control the amount of working fluid being compressed and thus the overall capacity of the compressor. When the slide stop and slide valve are spaced relative to one another a space is created therebetween which communicates the area of the intermeshing rotors with the inlet side of the compressor thus preventing any compression in the spaces between the lands and grooves between the slide stop and the slide valve. Maximum capacity is achieved when the slide stop and slide valve are abutted in an end-end relationship with respect to one another thereby preventing any of the working fluid from exiting the compression chambers created between the lands and grooves along the length of the rotors after entering the compressor inlet. Therefore, the slide valve configurations of rotary screw compressors allow an infinitely variable capacity to be maintained which simultaneously results in very efficient compressor loading.

Various means have been employed to guide the slide valve and slide stop to prevent contact or interference with the rotors. An essential in conventional compressors is to retain the slide valve in a position for insuring very tight clearances with respect to the rotors. One such method for accomplishing this guidance task is by machining a guide surface into the inlet and discharge casings for the compressor housing which have the same radius as the top concave sides of the slide valve and slide stop. In this respect, it should be noted that the upper surface of the slide valve assembly is defined having two concave surfaces which meet at a central crest or apex which is designed to extend closely to, but intermediate, the intermeshed rotors. The prior art guide surface is machined by circle interpolation relative to bearing bores provided in each of the inlet and discharge casings of a compressor. The centers are located utilizing separate dowel pins between portions of the central housing of the compressor and the inlet and outlet end casings. Due to the number of possible tolerances which must be considered, there is generally no way of precisely measuring the guide surface position when machining the guide surfaces. Thus, with conventional compressors, some hand fitting has necessarily been required during compressor assembly to provide for accurate tolerances between the surfaces of the slide valve and slide stop and the rotors.

The tolerances involved with current compressors include the following:

for the discharge casing; the tolerances associated with the guide surface radius at the discharge casing, the guide surface to dowel pin center, the bearing bore to dowel pin center, and the bearing bore to guide surface relationship.

For the rotor housing; the dowel pin center to rotor bore, the rotor bore to slide valve bore and the slide valve bore tolerance.

For the slide valve; the slide valve outside diameter tolerance as it relates to the rotors, the slide valve center to bore center tolerance and the tolerances associated with the bores of the rotors.

In view of the foregoing, there remains a need to provide for a closer and more accurate guiding of the slide valves and slide stops of rotary screw compressors without requiring additional manual modification of the components during assembly.

SUMMARY OF THE INVENTION

The present invention is directed to a method and apparatus for providing accurate guidance and close tolerance for and between a slide valve or an assembly, including slide valve and slide stop, and the working rotors of a rotary screw compressor. The invention provides for a first pair of bushings to be mounted within bores in which the support bearings for the rotors are located. Each of the first bushings includes an inner annular sleeve which is machined to provide a close fit within the bearing bore within the inlet casing of the compressor. Each of the first bushings further includes an outer semi-annular flange which extends radially outwardly with respect to the central axis of the bushing relative to the annular sleeve such that an arcuate convex surface portion of each bushing provides a guide surface for engaging an arcuate concave portion of one half of the upper surface of a slide valve or slide stop. The guidance surface portion of each bushing is machined so as to have a radius substantially equal to the radius defining the arcuate concave upper surface portion associated with the slide valve and slide stop.

Each of the first bushings also includes a flat extending along the outer flange so that when the bushings are mounted within adjacent bearing bores, the flats oppose each other in closely spaced relationship and thus the flanges of the bushings do not interfere with one another.

The invention further contemplates the use of second bushings adapted to be installed in bearing bores associated with the discharge casing of the compressor. Each of the second bushings includes a central annular sleeve adapted to be closely fitted by machining within the bearing bores in the discharge casing and further include outer semi-annular flanges which extend outwardly relative to an axis with respect to the inner sleeve thereof. The flanges also include arcuate convex guide surfaces which are utilized to engage and guide an upper arcuate concave surface portion of the slide valve with the radius and curvature being machined with respect to the guide surfaces of each bushing to be substantially the same as the radius defining the curvature of the upper concave surfaces of the slide valve. As with the first bushings, flats are provided in each of the flanges so that when the bushings are installed within the bushing bores in the discharge casing, there is no interference between the two flanges. In order to prevent leakage, in some embodiments, a recess or groove is formed in one or both of the opposing flats of the flanges with an appropriate sealing material being placed within the groove.

The second bushings also are profiled to provide fluid passageways in the event the flanges extend in communication with any portion of the discharge outlet through the discharge casing of the compressor. The profiled openings are provided through the outer flanges.

It is a primary object of the present invention to provide a method and bushings for use with rotary screw compressors which will ensure an accurate guidance for a slide valve or assembly of a slide valve and slide stop associated therewith to thereby provide optimum tolerances between the slide valves and slide stops and the intermeshing rotors of the compressors without any interference between these components.

It is also an object of the present invention to guide components for accurately positioning slide valves or assemblies of slide valves and slide stops relative to the intermeshing rotors of rotary screw compressors wherein guide surfaces are created by accurately machining bushings which are installed in bearing bores of compressors so that guide surfaces thereof match the configuration and tolerances associated with the rotors of the screw compressors and with the arcuate surfaces associated with the slide valves and slide stops.

It is yet a further object of the present invention to provide guidance bushings for use with rotary screw compressors wherein the bushings not only provide means for providing accurate guidance for the slide stops and slide valves associated therewith, but which also include annular outwardly extending flanges which may also be utilized to accurately align sections of compressor housings as the housings are assembled.

It is a further object of the present invention to provide guidance bushings for use with rotary screw compressors for ensuring accurate tolerances and positioning of slide valves and slide stops relative to the intermeshing rotors of the compressors wherein the bushings can be utilized and installed interchangeably as wear occurs.

It is another object of the present invention to provide guide bushings for use in rotary screw compressors for accurately guiding slide valves and slide valve and slide stop assemblies such that there is a substantial reduction in manually altering of component tolerances during compressor assembly.

DESCRIPTION OF THE PREFERRED EMBODIMENT

Figure 1:
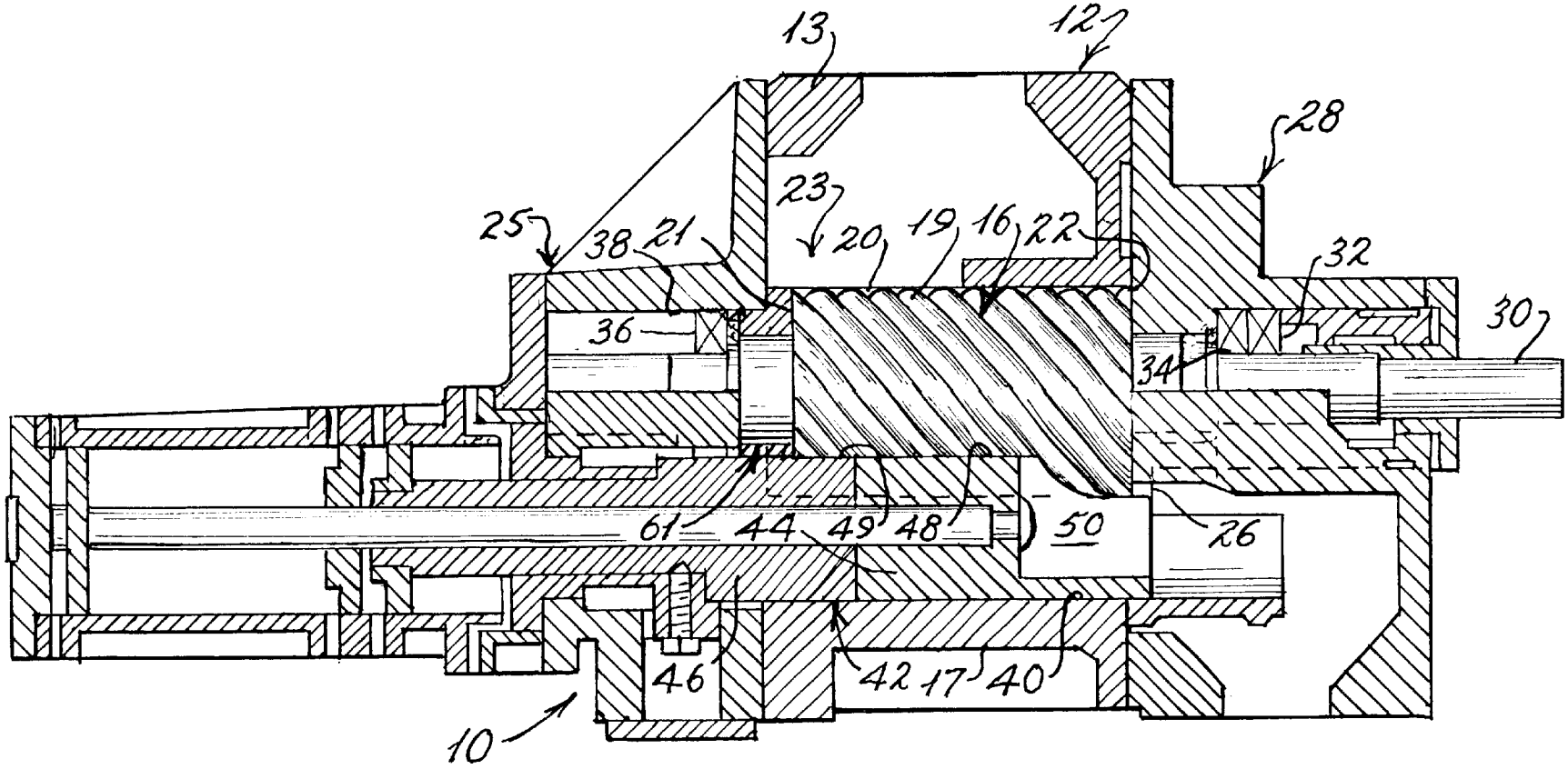
FIG. 1 is a cross sectional view of a rotary screw compressor showing one of a pair of first guidance bushings utilized to guide a slide stop portion of a slide valve and slide stop assembly of a rotary screw compressor in accordance with the teachings of the present invention.

With continued reference to the drawing figures, a rotary screw compressor 10 is shown as including a central housing 12 having left and right sections 25 and 28 which are assembled by appropriate bolts or other fasteners, not shown. When the housing sections are secured together, they define a pair of parallel intersecting rotor chambers or bores 14 and 15 in which are mounted intermeshing rotors 16 and 18, respectively. Each rotor includes a plurality of elongated spiral lands 19 and grooves 20 which extend from an inlet face 21 of each rotor to a discharge face 22 thereof. When mounted in intermeshing relationship, each intermeshing land and groove forms a continuous pocket in which a fluid is compressed as the rotors are rotated and as the fluid passes from adjacent the inlet face 21 to the discharge face 22 of the rotors.

A fluid, such as a refrigerant gas, enters the compressor through an inlet 23 in the central housing which is adjacent an inlet casing 25 which closes the inlet side of the chambers 14 and 15 of the compressor. After the working fluid is compressed, the fluid is discharged through a discharge opening 26 in a discharge casing 28 which closes the discharge end of the rotor chambers 14 and 15.

Each of the rotors 16 and 18 is supported by appropriate shafts in bearings mounted within bearing bores formed in the inlet casing 25 and the outlet casing 28. With specific reference to FIGS. 1 and 2, rotor 16 includes a drive shaft 30 which extends outwardly of the compressor housing and the discharge casing 28 which drive shaft 30 is connected to an appropriate drive source, such as a motor (not shown). The drive shaft is rotatably supported within a bearing assembly 32 mounted within a bearing bore 34 formed in the discharge casing 28. The opposite end of the shaft 30 is supported within bearings 36 mounted within a bearing bore 38 provided in the inlet casing of the compressor. The rotor 18 is similarly mounted except as opposed to having an elongated drive shaft 30, mounted to suitable bearings such as shown at 32 and 36 within bearing bores similar to 34 and 38. Positioned centrally beneath the bores 14 and 15 and having an axis generally parallel with respect thereto is a longitudinally extending secondary bore or recess 40 which communicates with both the inlet and the outlet ports of the compressor. Slidably mounted within the secondary bore 40 is a compound slide valve assembly 42 which includes a slide valve 44 and a slide stop 46. An upper surface 48 of the slide valve and 49 of the slide stop oppose the outer peripheral portions of the lands associated with the rotors 16 and 18 within the compressor housing.

Figure 3:
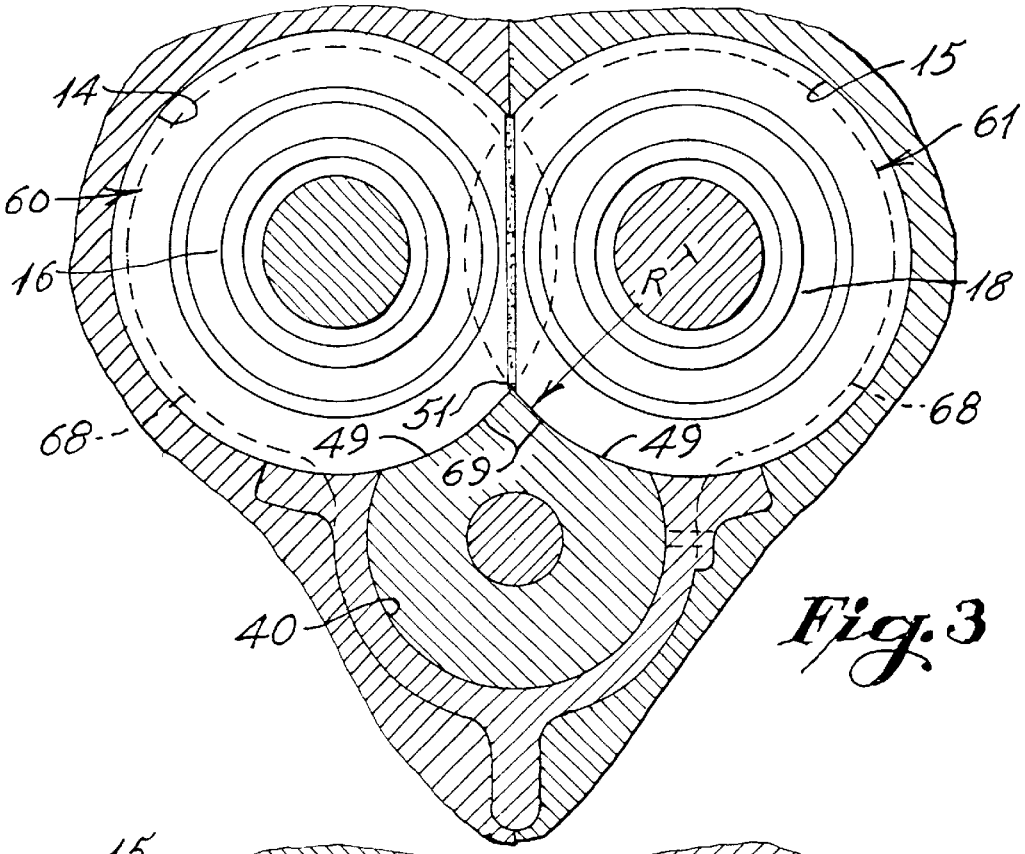
FIG. 3 is a cross sectional view taken along line 3—3 of FIG. 2.

With specific reference to FIG. 3, the upper surface of each of the slide stop and slide valve includes a pair of arcuate and concave surface portions which meet at generally central apexes 51 and 52 which are designed to be closely positioned intermediate the rotors 16 and 18. Each of the arcuate surface portions are defined along a radius "R". This radius is designed to provide an arc of a circle defined to be just slightly greater a than the radius of the rotors 16 and 18 such that the upper surfaces are positioned closely adjacent to the lands of the rotors. The movement of the slide valve 44 and the slide stop 46 within the secondary bore 40 may be controlled as disclosed in U.S. Pat. No. 4,516,914 to Murphy et al., the contents of which are incorporated herein by reference. It should be noted, that by moving a curved end face 50 of the slide valve relative to the discharge outlet 26, the compression ratio of the compressor may be changed whereas by changing the spacing between the slide stop and the slide valve, the grooves of the rotors are opened to the inlet side of the compressor thus varying the operating capacity of the compressor. However, in order to ensure that there is no interference between the interfacing surfaces of the slide valve and slide stop with the outer.periphery of the rotors, it is important to accurately guide the slide valve and slide stop in their reciprocating motion within the secondary chamber 40.

To provide guidance for the slide stop 49, a first pair of guide bushings 60 and 61 are designed and adapted to be mounted within the pair of bearing bores 38 provided within the inlet casing 25. In this respect, each of the bushings includes an inner annular sleeve 62 having an outside diameter substantially equal to the diameter defining the bearing bores 38 such that a tight fit is provided therebetween. A central opening 64 through the bushing may be formed with a bore and counterbore. Each bushing further includes a semi-annular outer flange 68 having a lower guide surface portion 69. The arcuate surface 69 is a convex surface having an outer radius defined by the same radius as the upper surfaces 48 and 49 of the slide valve and slide stop such that movement of the slide valve and slide stop relative thereto is controlled without interference between the guide surface 69 and the upper surface 49 of the slide stop. The bushings also include opposing flats 70 with are provided to prevent interference between the two bushings 60 and 61 when installed within the adjacent bearing bores 38 within the inlet casing 25, as shown in FIG. 3. To provide for longevity of the first bushings 60 and 61 during use, the metals from which the bushings are made may be substantially harder than the metal from which the slide stop and the slide valve are made. Further, by altering the configuration of the flange 68, portions of the flange may extend outwardly so as to provide for appropriate alignment of the discharge and rotor casing 12 by ensuring that contact surface portions of the flange 68 are appropriately configured to cooperatively engage portions of the inner surfaces of such housing sections.

Figure 2:
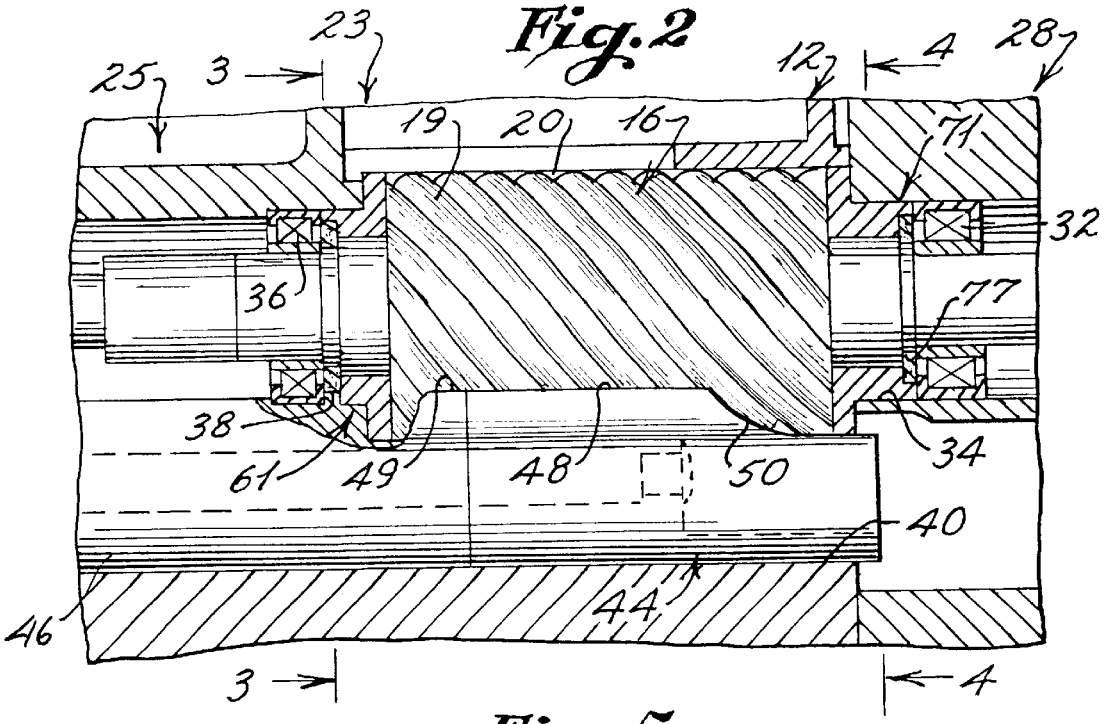
FIG. 2 is an enlarged partial cross sectional view of the rotary compressor of FIG. 1 showing first and second guidance bushings used at the inlet and discharge casings for guiding the slide stop and slide valve of the compressor.
Figure 5:
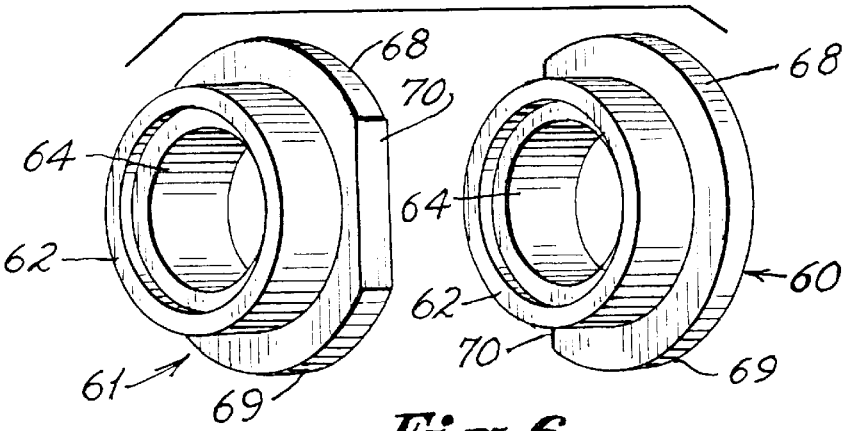
FIG. 5 is a perspective view of the two first bushings associated with the inlet casing of the rotary screw compressor shown in FIGS. 1 and 2.

With specific reference to FIG. 2, to also provide guidance for longitudinal shifting of the slide valve 44, a pair of second bushings 71 and 72 are provided for cooperatively seating within the bearing bores 34 associated with the discharge casing of the compressor. Each of the bushings includes an inner annular sleeve 73 which may be configured to define a central bore 74 having an outer counterbore 76 associated therewith which defines an inner flange. Each of the bushings 71 and 72 includes an outer flange 78 having a slide valve guide surface portion 79. The surface portion 79 is shown as being arcuate and convex in configuration and being formed along an arc of a circle having a radius substantially equal to the radius defined by the upper surface of the slide valve as shown at 48.

Figure 4:
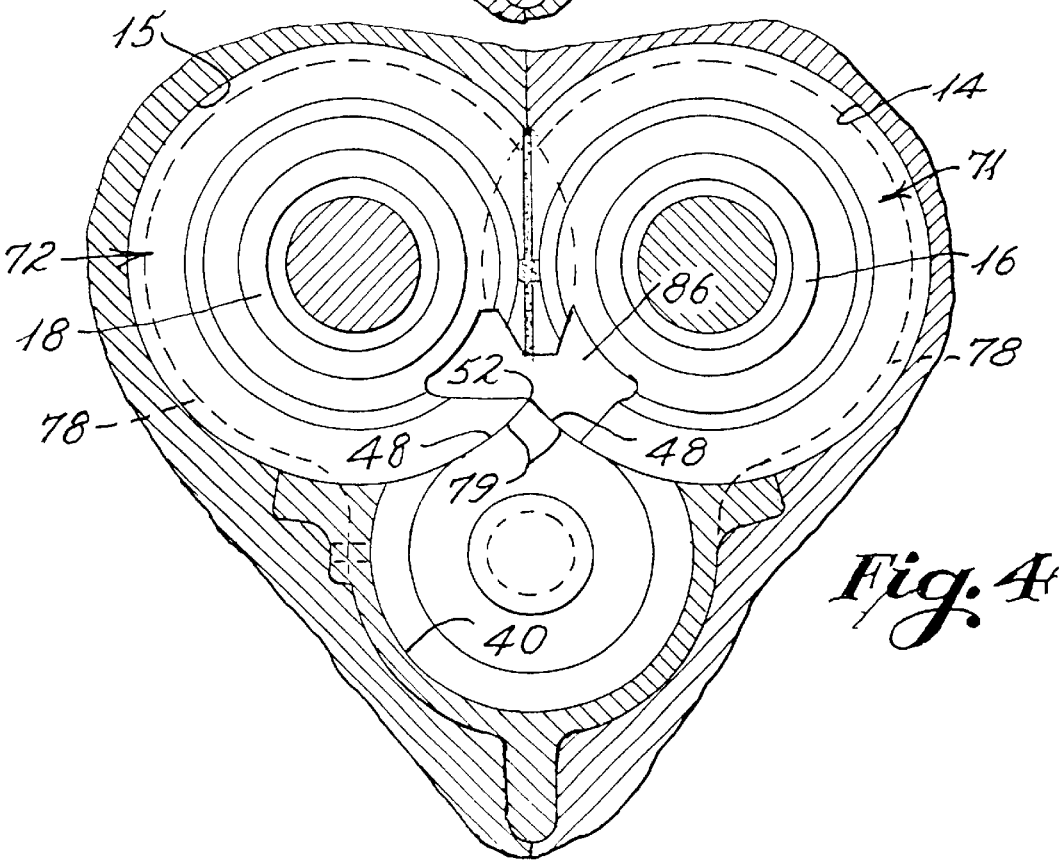
FIG. 4 is an enlarged cross sectional view taken along line 4—4 of FIG. 2 showing the discharge opening from the compressor chamber.

Each of the second or discharge bushings further includes a flat 80 such that when the bushings are mounted in side-by-side relationship, the flats oppose one another to prevent interference, as is shown in FIG. 4. Further, to prevent any leakage from discharge to suction of the compressor, at least one groove, such as shown at 81, is formed in one or both of the flats 80 of the discharge bushings 71 and 72. A sealant such as a rope or other type of material may be situated within the grooves 81 such that, when the bushings are assembled adjacent to one another, the interface therebetween is sealed. Further, to provide sealing with respect to the discharge casing, a groove 82 may be formed in the outer surface of each bushing which may also receive a conventional sealing material.

Figure 6:
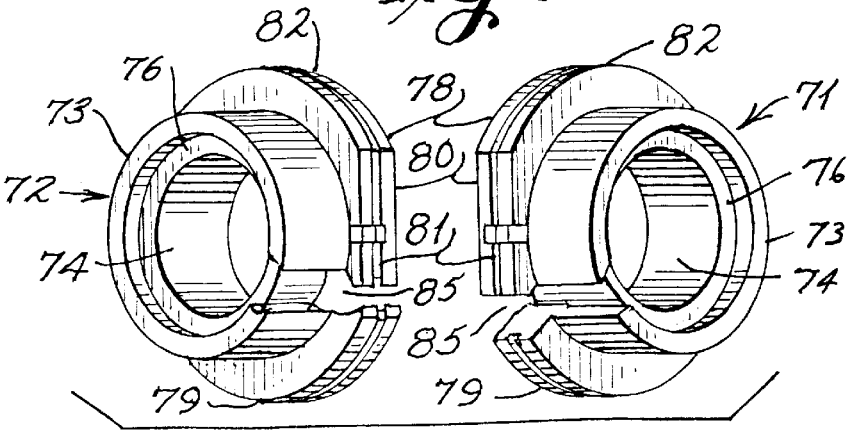
FIG. 6 is a perspective view of the two second guidance bushings associated with the discharge casing of the rotary screw compressor shown in FIG. 2.

As further shown in FIG. 6, it is necessary to modify the configuration of the discharge bushing 71 and 72 so as to provide the discharge opening 26 from the rotor chambers. As shown in FIG. 6, open slots 85 are cut through the flange and the central sleeve of each of the bushings 71 and 72 to provide the shaped opening in the discharge end of the housing, as shown at 86 in FIG. 4.

Again, as with the structure of the first or inlet guide bushings, the flanges of the second or discharge guide bushings may also be extended or be configured to provide for guidance when assembling the discharge end housing 28 with the rotor casing 12 of the compressor. To provide for longevity of the second bushings 71 and 72 during use, the metals from which the bushings are made may be substantially harder than the metal from the slide stop or the slide valve is made, however, in some instances they may be of softer metals to improve lubricity of the contact surfaces.

Figure 7:
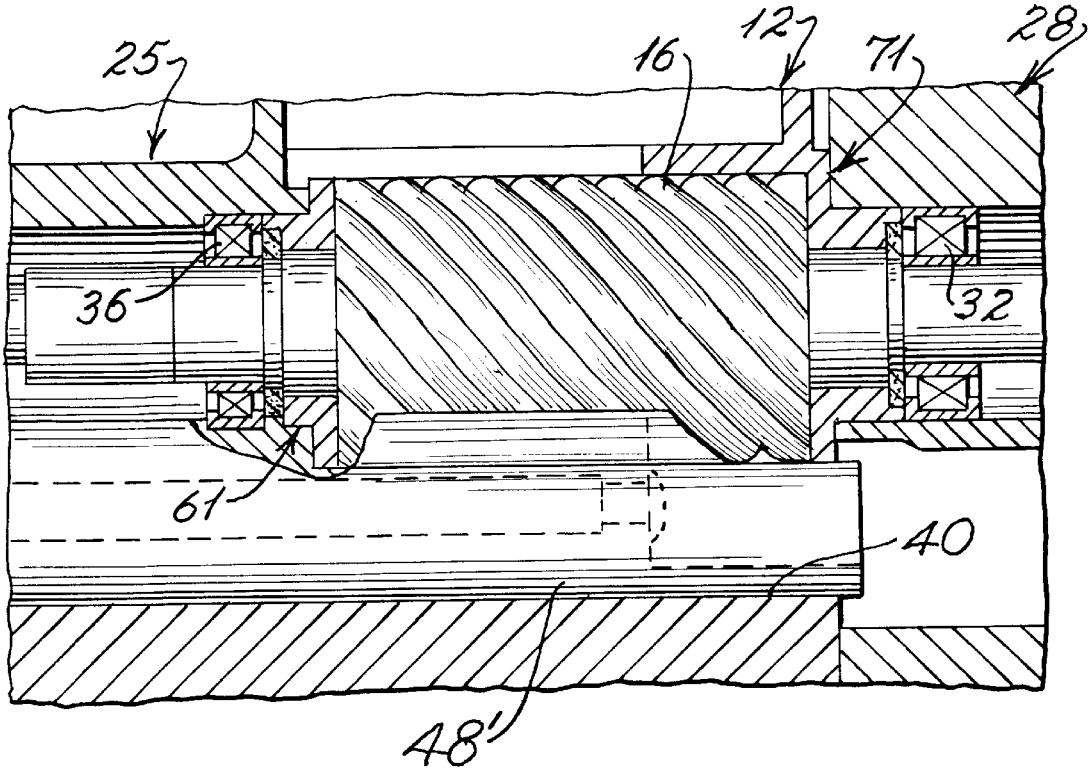
FIG. 7 is a view similar to FIG. 2 in a compressor incorporating only a slide valve.

With particular reference to FIG. 7, the bushings of the present invention may also be used in compressors which include only a slide valve 48' for controlling compression ratio by regulating the opening adjacent the discharge port of the compressor. The components of this embodiment which are the same as the previous embodiments have the same reference numbers.

In view of the prior description, it will be noted that it is possible to accurately provide for guidance of both the slide valve and slide stop utilizing pre-machined parts having guidance surface portions which are manufactured in strict tolerance with the arcuate surface portions of the slide valve and slide stop. Thus, the problems with obtaining proper tolerances between the components as is present in the prior art is alleviated by use of the guidance bushings of the present invention.

Although not shown in the preferred embodiment shown in the drawing figures, in some instances, the slide valve assembly may include only a single slide valve for capacity or volume ratio control.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. In a rotary screw compressor having a housing including generally parallel rotor bores which extend from a fluid inlet to a discharge outlet and wherein a pair of rotors having intermeshing lands and grooves are mounted by oppositely oriented rotor shafts which are rotatably supported in bearings provided in bearing bores adjacent the fluid inlet and discharge outlet, and wherein the compressor capacity is controlled utilizing a slide valve assembly including a slide valve which is moveable in a secondary bore which extends generally parallel to the rotor bores, the slide valve assembly having upper surface portions of a first configuration which surface portions oppose the rotors and wherein means are provided to slidably adjust the position of the slide valve, the improvement comprising; at least two first guide bushings each having an inner annular sleeve and an outer flange, each of said inner sleeves being cooperatively seated in one of the bearing bores adjacent the fluid inlet so as to be in surrounding relationship with the rotor shafts such that said outer flanges extend within the rotor bores, each of said outer flanges having a guide surface of a shape complementary to said first configuration of and engaging the upper surface portions of the slide valve assembly to thereby provide guidance for the slide valve relative to the rotors.

2. In a rotary screw compressor having a housing including generally parallel rotor bores which extend from a fluid inlet to a discharge outlet and wherein a pair of rotors having intermeshing lands and grooves are mounted by oppositely oriented rotor shafts which are rotatably supported in bearings provided in bearing bores adjacent the fluid inlet and discharge outlet, and wherein the compressor capacity is controlled utilizing a slide valve which is moveable in a secondary bore which extends generally parallel to the rotor bores, the slide valve having upper surface portions of a first configuration which surface portions oppose the rotors and wherein means are provided to slidably adjust the position of the slide valve, the improvement comprising; two first guide bushings each having an inner annular sleeve and an outer flange, each of said inner sleeves being cooperatively seated in one of the bearing bores adjacent the fluid inlet so as to be in surrounding relationship with the rotor shafts such that said outer flanges extend within the rotor bores, each of said outer flanges having a guide surface of a shape complementary to said first configuration of and engaging the upper surface portions of the slide valve to thereby provide guidance for said slide valve relative to the rotors, two second guide bushings each having an inner annular sleeve and an outer flange, each of said inner sleeves being cooperatively seated in one of the bearing bores adjacent the discharge outlet so as to be in surrounding relationship with the rotor shafts and such that said outer flanges thereof extend within the rotor bores, and each of said outer flanges of said second guide bushings having a guide surface of a shape complementary to said first configuration of and engaging the upper surface portions of the slide valve to thereby provide guidance for said slide valve relative to the rotors.

3. The rotary screw compressor of claim 2 wherein said flanges of each of said first and second guide bushings includes a flat portion which opposes the flat portion of an adjacent bushing to thereby prevent interference between said flanges of adjacent bushings.

4. The rotary screw compressor of claim 3 wherein said flat portion of at least one of said first and one of said second bushings includes a groove therein, and means mounted within said grooves for sealing an interface between flat portions of adjacent first and second bushings.

5. The rotary screw compressor of claim 3 wherein said inner annular sleeve of each of said first and second bushings defines a bore and counterbore.

6. The rotary screw compressor of claim 3 wherein said second bushings includes a cut out for providing an opening for the discharge outlet.

7. In a rotary screw compressor having a housing including generally parallel rotor bores which extend from a fluid inlet to a discharge outlet and wherein a pair of rotors having intermeshing lands and grooves are mounted by oppositely oriented rotor shafts which are rotatably supported in bearings provided in bearing bores adjacent the fluid inlet and discharge outlet, and wherein the compressor capacity is controlled utilizing a slide valve assembly including a slide valve and slide stop which are moveable in a secondary bore which extends generally parallel to the rotor bores, the slide valve assembly having upper surface portions of a first configuration which surface portions oppose the rotors and wherein means are provided to slidably adjust the position of the slide valve and a slide stop, the improvement comprising; at least two first guide bushings each having an inner annular sleeve and an outer flange, each of said inner sleeves being cooperatively seated in one of the bearing bores adjacent the fluid inlet so as to be in surrounding relationship with the rotor shafts such that said outer flanges extend within the rotor bores, each of said outer flanges having a guide surface of a shape complementary to said first configuration of and engaging the upper surface portions of the slide valve assembly to thereby provide guidance for one of said slide stop and slide valve relative to the rotors.

8. The rotary screw compressor of claim 7 wherein said flanges of each of said bushings includes a flat portion which opposes the flat portion of an adjacent bushing to thereby prevent interference between said flanges of adjacent bushings.

9. The rotary screw compressor of claim 8 wherein said flat portion of at least one of said bushings includes a groove therein, and means mounted within said groove for sealing an interface between flat portions of adjacent bushings.

10. The rotary screw compressor of claim 8 wherein said inner annular sleeve of each of said bushings defines a bore and counterbore.

11. The rotary screw compressor of claim 7 including two second guide bushings each having an inner annular sleeve and an outer flange, each of said inner sleeves being cooperatively seated in one of the bearing bores adjacent the discharge outlet so as to be in surrounding relationship with the rotor shafts and such that said outer flanges thereof extend within the rotor bores, each of said outer flanges of said second guide bushings having a guide surface of a shape complementary to said first configuration of and engaging the upper surface portions of the slide valve assembly to thereby provide guidance for the other of said slide valve and slide stop relative to the rotors.

12. The rotary screw compressor of claim 11 wherein at least one of said second bushings includes a radial extending groove for providing an opening for the discharge outlet.

13. The rotary screw compressor of claim 11 wherein said inner annular sleeve of each of said first and second bushings includes an opening defined by a bore and counterbore.

14. The rotary screw compressor of claim 11 wherein the flanges of each of said first and second bushings includes a flat it portion which opposes the flat portion of an adjacent bushing to thereby prevent interference therebetween.

15. The rotary screw compressor of claim 14 wherein said flat portion of at least one of said second bushings includes a groove therein, and means mounted within said groove for sealing an interface between adjacent flat portions of said second bushings.

16. In a rotary screw compressor having a housing which defines generally parallel rotor bores which extend from a fluid inlet adjacent an inlet casing to a discharge outlet adjacent an outlet casing and wherein a pair of rotors having intermeshing lands and grooves are mounted on oppositely oriented rotor shafts which are rotatably supported in bearings provided in bearing bores in both the inlet and discharge casings, and wherein the compressor capacity is controlled utilizing a slide valve and slide stop which are moveable in a secondary bore which extends generally parallel to the rotor bores, the slide valve and slide stop having an upper portion defined by a pair of concave surface portions defined by a first radius and each of which meet at a central apex which extends adjacent to the rotors and wherein means are provided to slidably adjust the position of the slide valve and the slide stop, the improvement comprising; a pair of first guide bushings mounted with the bearing bores of the inlet casing and a pair of second guide bushings mounted within the bearing bores of the discharge casing, each of said first and second guide bearings having an inner annular sleeve and an outer flange, each of said inner sleeves being cooperatively seated in one of the bearing bores so as to be in surrounding relationship with the rotor shafts such that said outer flanges extend within the rotor bores, each of said outer flanges having an arcuate convex guide surface of a radius substantially equal to the first radius and being engaged with one of the concave upper surfaces of one of the slide stop and slide valve to thereby provide guidance for said slide stop and slide valve relative to said rotors.

17. The rotary screw compressor of claim 16 wherein said inner annular sleeve of each of said bushings defines a bore and counterbore.

18. The rotary screw compressor of claim 16 wherein said flanges of each of said first and second guide bushings include a flat portion which opposes the flat portion of an adjacent bushing to thereby prevent interference between said flanges of adjacent bushings.

19. The rotary screw compressor of claim 18 wherein said flat portion of at least one of said bushings includes a groove therein, and means mounted within said groove for sealing an interface between flat portions of an adjacent bushing.

20. The rotary screw compressor of claim 18 wherein said flat portion of at least one of said second guide bushings includes a groove therein, and means mounted within said groove for sealing an interface between adjacent flat portions of said second guide bushings.

21. The rotary screw compressor of claim 18 wherein said second guide bushings includes a cut out groove formed in a portion thereof for providing the discharge opening.

* * * * *